US011286605B2

(12) United States Patent
Wecker et al.

(10) Patent No.: US 11,286,605 B2
(45) Date of Patent: Mar. 29, 2022

(54) STRUCTURAL UNIT, IN PARTICULAR HEATING PUMP, COMPRISING A HEATABLE TUBE SECTION FOR A WATER-CONDUCTING DOMESTIC APPLIANCE, AND WATER-CONDUCTING DOMESTIC APPLIANCE COMPRISING SUCH A STRUCTURAL UNIT

(71) Applicant: BSH Hausgeräte GmbH, Munich (DE)

(72) Inventors: Markus Wecker, Gundremmingen (DE); Stephan Lutz, Zusamaltheim (DE); Stephanie Karger, Wertingen (DE)

(73) Assignee: BSH Hausgeräte GmbH, Munich (DE)

( * ) Notice: Subject to any disclaimer, the term of this patent is extended or adjusted under 35 U.S.C. 154(b) by 440 days.

(21) Appl. No.: 16/319,829

(22) PCT Filed: Jul. 18, 2017

(86) PCT No.: PCT/EP2017/068116
§ 371 (c)(1),
(2) Date: Jan. 23, 2019

(87) PCT Pub. No.: WO2018/033329
PCT Pub. Date: Feb. 22, 2018

(65) Prior Publication Data

US 2019/0269294 A1 Sep. 5, 2019

(30) Foreign Application Priority Data

Aug. 16, 2016 (DE) ..... 102016215266.1

(51) Int. Cl.
*A47L 15/00* (2006.01)
*A47L 15/42* (2006.01)
(Continued)

(52) U.S. Cl.
CPC ..... *D06F 34/24* (2020.02); *A47L 15/0049* (2013.01); *A47L 15/4285* (2013.01);
(Continued)

(58) Field of Classification Search
None
See application file for complete search history.

(56) References Cited

U.S. PATENT DOCUMENTS 8,245,718 B2 8/2012 Buesing
8,733,375 B2 5/2014 Classen
(Continued)

FOREIGN PATENT DOCUMENTS

DE 3045121 A1 7/1982
DE 102014215853 A1 2/2016
(Continued)

OTHER PUBLICATIONS

National Search Report DE 10 2016 215 266.1 dated May 8, 2017.
(Continued)

*Primary Examiner* — Levon J Shahinian
(74) *Attorney, Agent, or Firm* — Michael E. Tschupp; Andre Pallapies; Brandon G. Braun

(57) ABSTRACT

A structural unit, in particular a heating pump for a water-conducting domestic appliance, in particular a domestic dishwasher, includes a heatable tube section through which a liquid can flow during operation and in which one or more mechanical structures are arranged that produce locally different flow speeds of the liquid. A first temperature measuring device is arranged on an outer side of the tube section radially outside a region of lower flow rate or less incident flow, and a second temperature measuring device is arranged on the outer side of the tube section radially outside a region of higher flow rate or more incident flow.

16 Claims, 9 Drawing Sheets

(51) Int. Cl.
*D06F 34/24* (2020.01)
*D06F 39/04* (2006.01)

(52) U.S. Cl.
CPC ..... *D06F 39/04* (2013.01); *A47L 15/4287* (2013.01); *A47L 2401/11* (2013.01); *A47L 2401/12* (2013.01); *A47L 2401/34* (2013.01); *A47L 2501/06* (2013.01); *A47L 2501/18* (2013.01); *A47L 2501/26* (2013.01)

(56) References Cited

U.S. PATENT DOCUMENTS

| | | | | |
|---|---|---|---|---|
| 2008/0077281 | A1 | 3/2008 | Gaus | |
| 2014/0369672 | A1* | 12/2014 | Hussain | D06F 39/045 392/480 |
| 2015/0337859 | A1 | 11/2015 | Li | |

FOREIGN PATENT DOCUMENTS

| | | | |
|---|---|---|---|
| DE | 102014224593 | A1 | 6/2016 |
| EP | 2478816 | A2 | 7/2012 |
| EP | 2842474 | A1 | 3/2015 |
| WO | 2014205771 | A1 | 12/2014 |

OTHER PUBLICATIONS

International Search Report PCT/EP2017/068116 dated Sep. 8, 2017.
Mational Search report CN 201780050024 dated Dec. 17, 2020.

* cited by examiner

STRUCTURAL UNIT, IN PARTICULAR HEATING PUMP, COMPRISING A HEATABLE TUBE SECTION FOR A WATER-CONDUCTING DOMESTIC APPLIANCE, AND WATER-CONDUCTING DOMESTIC APPLIANCE COMPRISING SUCH A STRUCTURAL UNIT

CROSS-REFERENCES TO RELATED APPLICATIONS

This application is the U.S. National Stage of International Application No. PCT/EP2017/068116, filed Jul. 18, 2017, which designated the United States and has been published as International Publication No. WO 2018/033329 A1 and which claims the priority of German Patent Application, Serial No. 10 2016 215 266.1, filed Aug. 16, 2016, pursuant to 35 U.S.C. 119(a)-(d).

BACKGROUND OF THE INVENTION

The present invention relates to a structural unit or heating device, in particular a heating pump, having a tube section through which, during operation, liquid can flow and can heat the tube section, for a water-conducting household appliance (1), in particular a household dishwasher or indeed a washing machine.

In such liquid heating devices for water-conducting household appliances, in particular dishwashers or washing machines, it is problematic to operate them using water having a high lime content without taking suitable measures for softening the water. Conversely, it is of the utmost importance to avoid using an excessive dose of chemicals that reduce the water hardness.

It is further possible for scale to be formed, in particular on the inner wall of the tube section—inside which liquid is conducted—of the heater or heating device of such a water-conducting household appliance, as a result of setting the wrong hardness level, using too little detergent, incorrectly using detergent tablets that contain no softening agents, using biological detergents, operating the appliance with no salt, failing to top up the salt, failure to detect a lack of salt, seizure of the regenerating valve, or a defective regenerating valve.

Such sources of error may result in the formation of scale on the parts of the heating device that come into contact with liquid, and may also lead to a breakdown and the deployment of customer service.

It is thus desirable to provide the customer promptly, before any damage occurs, with data that is as exact as possible on the formation of scale and/or the degree of limescale in the appliance, and the measures required.

For this purpose, for a water-conducting household appliance EP 2 842 474 B1 proposes a heating device having a wall, the first side whereof is equipped with a heating resistor arrangement and a temperature measuring arrangement associated therewith, and the second side whereof, over which liquid flows for the purpose of heating it, is equipped opposite the temperature measuring arrangement with a limescale accumulation region which has a greater tendency to accumulate limescale contained in the liquid than the rest of the region of the second side. This limescale accumulation region, which is on the second side of the wall, over which liquid to be heated flows, and lies opposite the temperature measuring arrangement, can in particular be provided by a surface structure having greater roughness than the rest of the region on the second side. However, this surface structuring necessitates additional steps in the processing of this side of the wall when such a heating device is manufactured. Moreover, it may in some cases create problems for the service life of this heating device to promote limescale accumulations of this kind.

BRIEF SUMMARY OF THE INVENTION

The object of the invention is to achieve an improvement on this.

The invention achieves this object by a structural unit or heating device, in particular a heating pump, having a tube section through which, during operation, liquid can flow and can heat the tube section, for a water-conducting household appliance, in particular a household dishwasher. Further advantageous embodiments and features of the invention are disclosed. A water-conducting household appliance that has a structural unit or heating device according to the invention is also disclosed.

The structural unit according to the invention, in particular a heating pump, for a water-conducting household appliance, in particular a household dishwasher, has a tube section through which, during operation, liquid can flow and can heat the tube section, and in which one or more mechanical structures are arranged that bring about locally differing flow rates in the liquid flowing through the interior of the tube section. At least two temperature measuring devices are associated with the outer side of the tube section. Because the first temperature measuring arrangement and the second temperature measuring arrangement are arranged on the outer surface of the tube section through the interior of which liquid flows, they are advantageously not acted upon by liquid there and so remain dry. This ensures that they remain functional over the long term. Because, in the structural unit according to the invention for heating liquid, that is to say the liquid heating device, a first temperature measuring device is arranged radially outside a region of lower flow rate and less incident flow (against the tube section through the interior of which liquid flows), and a second temperature measuring device is arranged radially outside a region of higher flow rate and more incident flow (against the tube section through the interior of which liquid flows), there is a different amount of incident flow on the inner wall at the points on the tube section at which the two temperature measuring devices are arranged on the outer wall, resulting in a temperature difference between the two measuring points. The temperature measuring device at which there is more incident flow is at a lower temperature, since the dissipation of heat is greater here as a result of the incident flow. The thicker a layer of limescale becomes at the measuring point at which there is less or slower (and hence hotter) incident flow, the greater the difference in temperature.

According to an advantageous development of the invention, it is favorable if the first temperature measuring device is mounted on the outside of the tube section at a first measuring point below which the flow rate of the liquid in the interior of the tube section through which liquid flows is at least 10%, in particular between 10% and 20%, less than the flow rate of the liquid at a second measuring point in the interior of the tube section through which liquid flows, above which the second temperature measuring device is arranged on the outside of the tube section. At each measuring point there is preferably produced a mix temperature resulting from the heating temperature prevailing at the measuring point, which is brought about there by the heater that acts on the outside of the tube section, and the temperature of the liquid as it meets the inner side of the tube section opposite the measuring point on the outside of the tube. At this point on the tube section, the tube wall is thus heated from the outside by the heater and cooled in the interior by the liquid flowing there. As a result of the different incident flow rates of the liquid or, to put it in general terms, the different liquid incident flow conditions at the two measuring points, there is already, in the scale-free initial condition of the tube section through which liquid flows, an initial temperature difference between the different prevailing temperatures at the two different measuring points of the tube section as a result of the different incident flow conditions that is sufficiently high for conventional inaccuracies in measurement, in particular of the temperature sensors such as NTCs, between the two temperature measuring devices or other disruptive factors to be negligible by comparison with this initial temperature difference. This helps to achieve a reliable, robust determination of the temperature difference between the temperature measurement values that are respectively detected by the two temperature measuring devices at the two different measuring points. This is particularly the case if the temperature difference determined in each case from the temperatures currently detected at the two measuring points by the two temperature measuring devices, and all the more so if the formation of scale on the inner wall of the tube section starts below the first measuring point and then spreads further and further.

In this way, the invention makes it possible to evaluate the temperature signals such that scale formed on the inner wall side of the tube through which liquid flows can be detected properly or reliably, and in particular also at an early stage. In that case, it is possible for example to display to the customer the fact that the operating conditions are not optimal for the household appliance; the customer can then initiate suitable counter-measures, for example changing the setting for the water hardness or descaling the appliance. These counter-measures may also be additionally or independently automated or performed automatically by a control unit associated with the heating device according to the invention. This control unit is preferably a constituent part of a water-conducting household appliance.

It will be appreciated that the term "tube section" should also be understood to include a vessel through which liquid flows, or similar.

Particularly favorably, the first temperature measuring device has better heat transfer with a heat conductor than the second one does. This increases the temperature difference between the two measuring points, and it also gives a measurable temperature difference initially, before any limescale has accumulated, lying above the tolerance of the individual temperature detecting devices, in particular sensors.

For such a pronounced measurable temperature difference even without an already existing accumulation of limescale, with heating by way of external heat conductors it is favorable if the first temperature measuring device is arranged directly on or closely adjacent to a heat conductor and the second is at a greater spacing from this and further heat conductors.

Equipping the temperature measuring devices with sensors, in particular NTC sensors, and where appropriate also PTC sensors, makes a spatially compact and flat construction possible.

In particular, the temperatures of the two measuring devices can be repeatedly detected at regular intervals in time, as a result of which the difference in the temperatures of the two measuring devices can also be detected in an automated manner, and above a predeterminable limit value an information signal or control signal can be generated in particular by a control unit associated with the structural unit. Preferably, a message can be output to the user or customer from the household appliance. The customer thus receives a clear display of when it will be time for him or her to take measures, for example to prevent continued limescale formation. This limit value is selected such that it occurs well before the risk of damage to the appliance.

Favorably, for a small size of the structural unit and highly effective heat transfer, heat conductors having a component in the peripheral direction of the tube section may be laid on the latter or printed directly or indirectly on a wall of the tube section.

For the purpose of good heat transfer, the or a wall of the tube section may be made from stainless steel. In that case, an electrical insulation layer is arranged between it and the heat conductors. In particular, the wall takes the same form throughout its extent and does not require any further machining steps. Preferably, the tube section takes the form of a circle cylinder.

In a household dishwasher according to the invention, the liquid in the tube section of the heating device according to the invention is preferably a washing liquid that is circulated multiple times and comprises water provided with detergent and/or drying agent, such as rinse aid. Here, the temperature of the liquid may vary over the course of the washing program, as may the chemical composition. This is not critical, since the relevant criterion is not the absolute temperature but the difference between the two measuring points.

In particular if the structural unit according to the invention is a circulating pump, in particular a heating pump, the one or more structures affecting the flow rates may be formed by at least one guide element that directs the liquid in the interior of the tube section. During this, the washing liquid is for example drawn in centrally and axially by suction in the draw-in direction, through a draw-in connection piece and into the impeller wheel chamber or pump chamber, and is then distributed radially outward there by an impeller wheel that is driven in rotation, and is thereafter guided, in opposition to the direction in which it was drawn in, through a diffusor/pressure chamber that is downstream of the impeller wheel chamber, as seen in the direction of flow, and is in particular annular (as seen in cross section) and whereof the inner delimiting wall is at least partly formed by the guide element and whereof the outer delimiting wall is at least partly formed by the heating tube section, and is finally guided to an outlet. In the pump diffusor chamber/pressure chamber of the heating pump, the guide element in particular ensures optimization of flow in that some of the circular speed component of the liquid flow is converted to an axial speed component, such that the liquid from the impeller wheel chamber passes in the form of a spiral progressing in the axial outward flow direction through the diffusor/pressure chamber, which is in the shape of an annular gap, to the pressure connection piece of the heating pump on the output side. As a result, good thermal interaction is ensured between the liquid passing through the tube section and the heater on the outside of the wall of the tube section, for the purpose of efficiently heating the liquid to a desired temperature.

If it is possible to produce incident flow against the guide element by way of the impeller wheel, which is rotatable about the central axis of the tube, it is useful for deflection of the liquid if the thus incident liquid can be directed by way of a plurality of guide blades, which extend from the preferably circle-cylindrical base element of the guide element in a component that extends both axially and radially outward, in a substantially spiral direction of flow. This also makes the interaction with the heater on the outside of the wall particularly effective.

As a result of this arrangement of the guide blades, with their oblique profiles to the outside on the preferably circle-cylindrical base element of the guide element, it is moreover possible to bring about the locally varying flow rates of the liquid in the tube section, which can then be used to measure the temperatures and to calculate the difference.

In particular, it is favorable if the first temperature measuring device is mounted on the outside of the tube section at a first point below which there extends, in the interior of the tube section, the portion of a guide blade of the guide element that projects radially from the in particular circle-cylindrical base element of the guide element, and the second temperature measuring device is mounted on the outside of the tube section at a second point which is different from the first point and closer to the ejection region of the impeller wheel, in particular below which the ejection region of the impeller wheel lies. This advantageous arrangement has been successfully tested with a liquid heating pump of a household dishwasher. This liquid heating pump has as its constituent parts a circulating pump and a heating device that takes a form according to the invention, preferably in a common housing. Its two temperature measuring devices are preferably at a spacing from one another of at least 2 mm, in particular between 5 mm and 12 mm.

Further advantages and features will be apparent from the exemplary embodiments of the subject matter of the invention, which are illustrated in the drawing and described below.

DETAILED DESCRIPTION OF EXEMPLARY EMBODIMENTS OF THE PRESENT INVENTION

Figure 1:
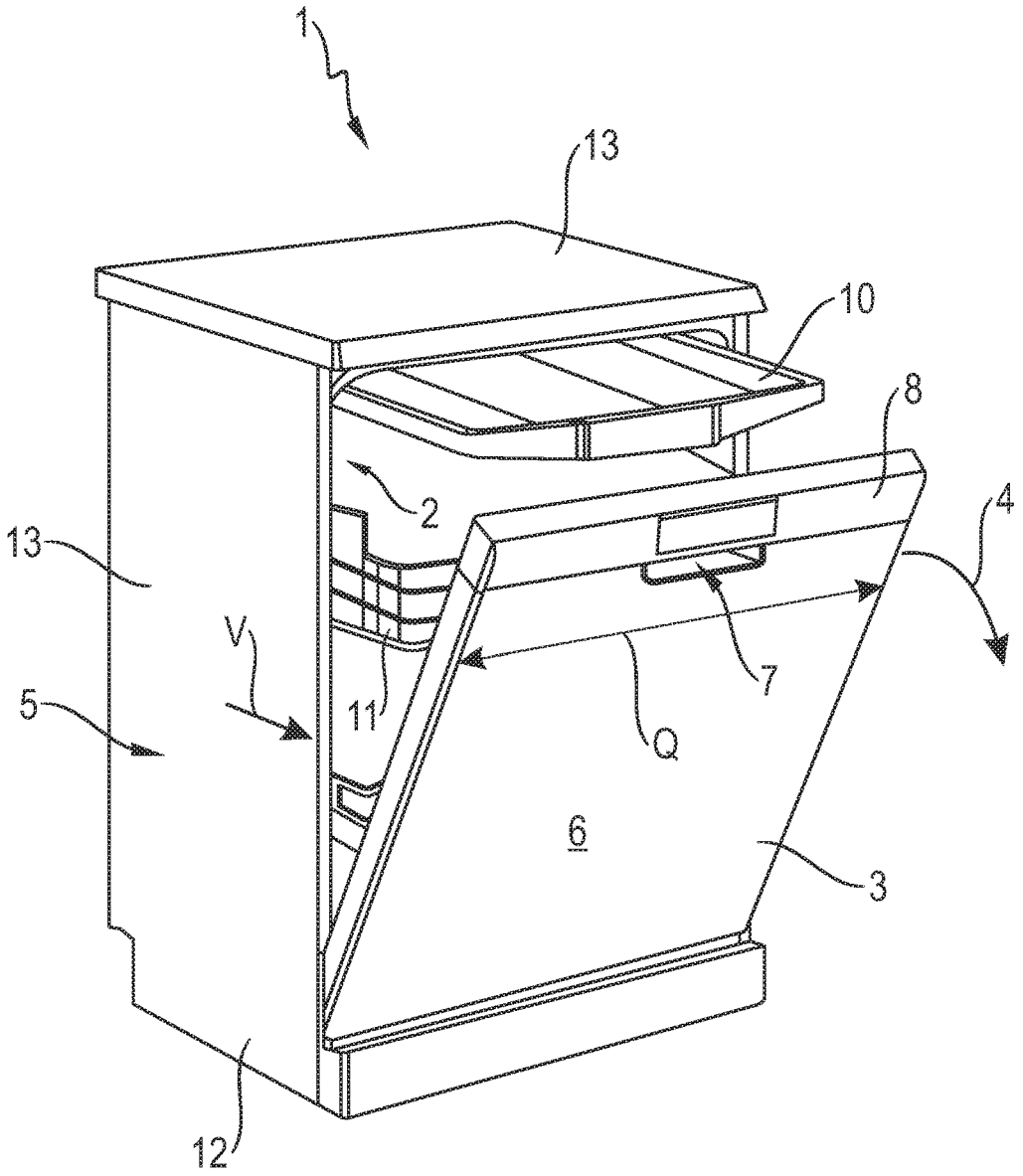
FIG. 1 shows a schematic perspective view, obliquely from the front, of an embodiment of a dishwasher, having a door that in this case is on the front side.

The dishwasher 1 that is illustrated schematically in FIG. 1 is a household dishwasher and has, as a constituent part of a partly outwardly open or closed carcass 5, a washing vessel 2 for receiving articles for washing, such as dishes, pans, cutlery, glasses, cooking utensils and the like. The articles for washing may in this case be mountable for example in racks 11 and/or a cutlery drawer 10 and in this situation may be processable with so-called washing liquor. Here, the term "washing liquor" is understood to mean clean water, or in particular water circulating during operation, with or without detergent and/or rinse aid and/or drying agent. The washing vessel 2 may have an at least substantially rectangular footprint with a front side V that in the operative position faces a user. Here, this front side V may be part of a kitchen unit comprising pieces of kitchen furniture standing next to one another, or in the case of a free-standing appliance may also have no connection to further pieces of furniture.

The washing vessel 2 is in particular closable at this front side V by a door 3. In FIG. 1, this door 3 is shown in a position that is partly open and is thus at an angle to the vertical. In its closed position, by contrast, it is upright and according to the drawing, for the purpose of opening it, it is pivotal about a lower horizontal axis, forward and downward in the direction of the arrow 4, such that when it is in the fully open position it lies at least almost horizontal.

On its outer and front side V, which in the closed position is vertical and faces the user, the door 3 may be provided with a decorative panel 6 in order to enhance it visually and/or to the touch, and/or to match it to kitchen furniture around it.

Here, the dishwasher 1 takes the form of a free-standing or so-called partly fitted or indeed fully fitted appliance. In this last case, the carcass 5 may also terminate substantially with the outer walls of the washing vessel 2. A housing surrounding this on the outside may in that case be unnecessary. In the lower region of the dishwasher 1, there may be a base 12 for receiving in particular functional elements.

In the exemplary embodiment according to the drawing, there is associated with the movable door 3 in its upper region an operating panel 8 that extends in the transverse direction Q of the dishwasher 1 and can include a recessed handle 7, accessible from the front side V, for opening and/or closing the door 3 manually. In the transverse direction Q, the dishwasher frequently has an extent of 45, 50 or 60 centimeters. In the direction of depth, from the front side V to the rear, the extent is frequently likewise around 60 centimeters. These values are not mandatory.

The washing vessel 2 is delimited peripherally when the door 3 is closed by a total of four vertical walls 13 and two horizontal walls 13, of which one forms a top and a further one forms a floor of the washing vessel 2. In this arrangement, the closed door 3 itself forms one of the vertical walls 13 by its inner door, which in the closed position faces the washing vessel 2. Instead of the dishwasher shown here, other water-conducting household appliances such as a washing machine may also take a form according to the invention.

This water-conducting household appliance 1, here the illustrated household dishwasher, is provided with at least one structural unit 14, which includes a tube section 15 through which, during operation, liquid can flow and can heat the tube section. This liquid may be formed by the washing liquor mentioned above. The structural unit 14 may be arranged for example at the bottom in the base 12 of the dishwasher 1, and in its entirety forms in particular a heating pump 16—that is to say a pump that circulates liquid—that at the same time is heatable by way of a heater 17, for the purpose of heating the liquid conveyed in the interior of the tube section 15, and hence performs a dual function. It is also possible for these two functions to be structurally separate.

The liquid in the tube section 15 may be a washing liquid that is circulated multiple times and comprises water provided with detergent and/or drying agent. Liquid of this kind is frequently also designated washing liquor.

The peripheral wall 18 of the tube section 15 may for example be made from stainless steel, which has good heat conductivity and is chemically stable. Ceramic or other materials are also possible. Here, at least the wall surface of the tube section 15 that points toward the interior through which there is flow takes the same form throughout in the axial direction, and so needs no further machining steps, which simplifies manufacture. Here, the tube section may—but need not—have circular symmetry in cross section.

Arranged in the tube section 15 are mechanical structures 19, 20 that, together with an impeller wheel 21 of the pump, direct the liquid there on an approximately spiral path along the wall 18 and bring about the locally differing flow rates of the liquid. These structures 19, 20 are described in more detail below.

Associated with the outer side 24 of the tube section 15 are at least two temperature measuring devices 22, 23 that are at a spacing from one another. The spacing between them may be in the region of a few centimeters. The temperature measuring devices may be directly or indirectly connected to the outer side 24 of the wall 18.

Here, a first temperature measuring device 22 lies radially outside a region of lower flow rate or less incident flow a, and a second temperature measuring device 23 lies radially outside a region of higher flow rate or more incident flow A. Favorably, the first temperature measuring device 22 is mounted on the outside of the tube section 15 at a first measuring point below which the flow rate of the liquid in the interior of the tube section 15 through which liquid flows is at least 10%, in particular between 10% and 20%, less than the flow rate of the liquid at a second measuring point in the interior of the tube section 15 through which liquid flows, above which the second temperature measuring device 23 is arranged on the outside of the tube section. At each measuring point there is preferably produced a mix temperature resulting from the heating temperature prevailing at the measuring point, which is brought about there by the heater mounted on the outside of the tube section, and the temperature of the liquid as it meets the inner side of the tube section opposite the measuring point on the outside of the tube. At this point on the tube section, the tube wall is thus heated from the outside by the heater and cooled in the interior by the liquid flowing there. As a result of the differing incident flow rates of the liquid or, to put it in general terms, differing liquid incident flow conditions at the two measuring points, there is already, in the scale-free initial condition of the tube section through which liquid flows, an initial temperature difference between the different prevailing temperatures at the two different measuring points on the tube section because of the different incident flow conditions that is sufficiently large for conventional inaccuracies in measurement, in particular of the temperature sensors such as NTCs, between the two temperature measuring devices or other disruptive factors to be negligible by comparison with this initial temperature difference. This helps to achieve a reliable, robust determination of the temperature difference between the temperature measurement values that are respectively detected by the two temperature measuring devices at the two different measuring points. This is particularly the case if the temperature difference ΔT determined in each case from the temperatures T1, T2 currently detected at the two measuring points by the two temperature measuring devices 22, 23, and is all the greater if the formation of scale on the inner wall of the tube section starts below the first measuring point and then spreads further and further.

Figure 3:
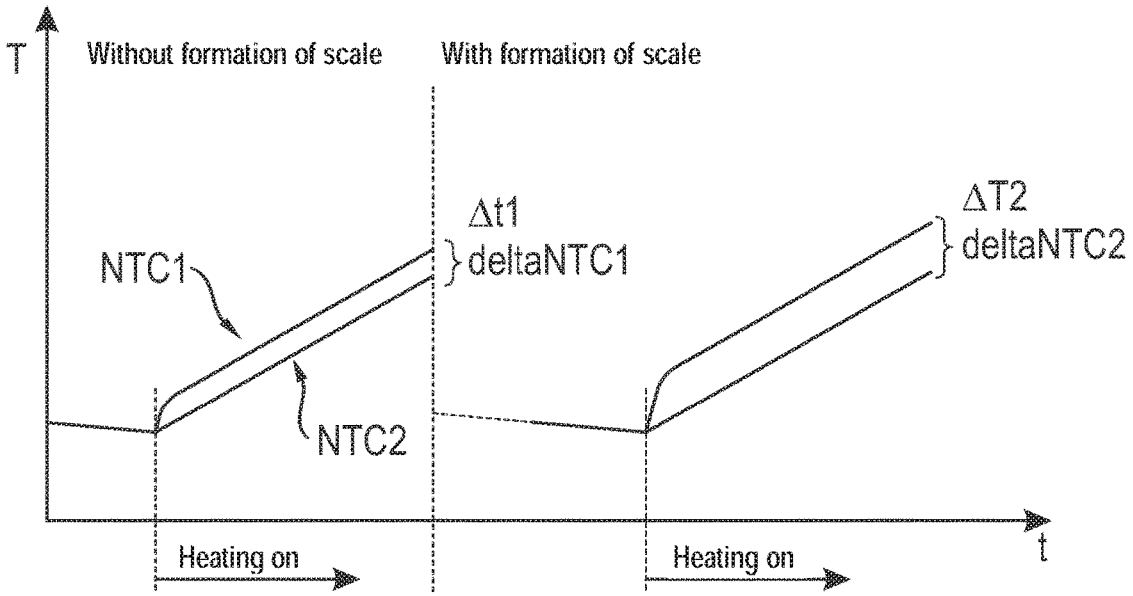
FIG. 3 shows, illustrated next to one another, the temperatures measured without (on the left) and with (on the right) the formation of scale.

It is significant for the arrangement of the two temperature measuring devices that the tube section 15 may be heated from the outside by way of heat conductors 25 arranged on the outer side 24 of the tube section 15. These heat conductors 25 may extend on the outer side 24 in a serpentine fashion, for example as a thick-film or a thin-film heater. Thus, the heat conductors 25 having a component in the peripheral direction of the tube section 15 may be laid on the latter or printed directly or indirectly onto a wall 18 of the tube section 15. If the wall 18 of the tube section 15 is made of metal, there is also an insulation layer between it and the heat conductors 25.

Where such heat conductors 25 are present, it is favorable if the first temperature measuring device 22 has better heat transfer with a heat conductor 25 than the second one 23 does. For this purpose, the first temperature measuring device 22 is directly arranged on or closely adjacent to a heat conductor 25, while the second 23 is at a greater spacing from this and further heat conductors 25. For this reason, even without flow over the interior of the tube section 15 and even without the formation of a layer of scale B, a small difference in temperature is already measurable when the heat conductors 25 are switched on, as illustrated in FIG. 3. In FIG. 3, time is shown along the x axis and temperature T along the y axis. The difference in temperature that is produced when no scale is present is shown there as ΔT1 (=deltaNTC1). The greater difference in temperature that is established when scale begins to form is shown as ΔT2 (=deltaNTC2).

For an inexpensive and compact arrangement, the temperature measuring devices 22, 23 may each include sensors. In particular, these sensors may take the form of semiconductor sensors and form for example NTC or PTC sensors in which the respective electrical resistance is a measure of the current temperature.

Figure 2:
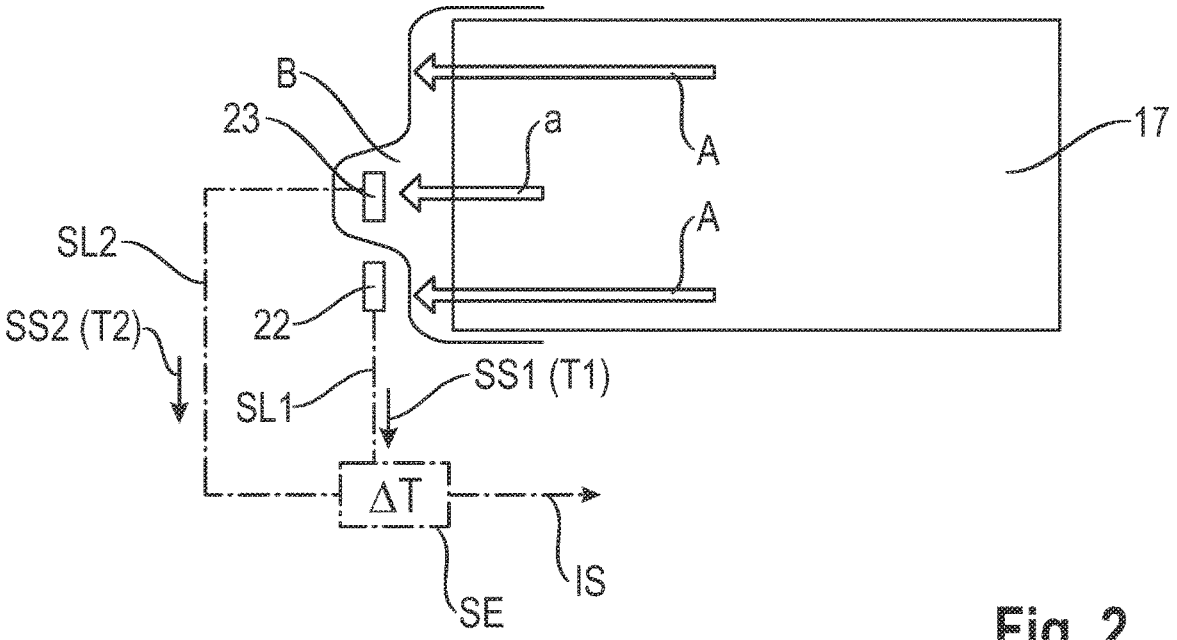
FIG. 2 shows a schematic illustration of a heated surface having differing incident flow over its extent (characterized by arrows A and a respectively of differing length), with a consequently differing scale formation, and having two temperature sensors.

The first temperature measuring device 22 is connected to a control unit SE by way of a signal line SL1—indicated in dot-and-dash lines in FIG. 2. The control unit SE may for example be installed in the central control device of the dishwasher. The second temperature measuring device 23 is analogously connected to the control unit SE by way of a signal line SL2. The first temperature measuring device 22 transmits temperature measurement signals SS1 of the temperature T1 at the first measuring point of the tube section, by way of the signal line SL1, to the control unit. The second temperature measuring device 23 transmits temperature measurement signals SS2 of the temperature T2 at the second measuring point of the tube section, by way of the signal line SL2, to the control unit SE. From the measurement signals SS1, SS2 for the first temperature T1 and the second temperature T2, the control unit SE generates the respectively current temperature difference ΔT. If this exceeds a critical limit value, the control unit SE generates an information signal IS. With the aid of this information signal IS, the fact that the operating conditions are not optimal for the household appliance may for example be displayed to the user of the dishwasher. The user can then initiate suitable counter-measures, for example changing the setting for the water hardness or descaling the appliance. These counter-measures may also be additionally or independently automated or performed automatically by the control unit SE associated with the tube section 15 or the heating device.

The temperatures of the two temperature measuring devices can be repeatedly detected at regular intervals in time during operation of the household appliance 1, wherein the difference between the temperatures of the two temperature measuring devices 22, 23 may be detected in automated manner in the household appliance 1 by way of an electronic evaluation, and above a limit value for this difference a message may be output by the household appliance 1.

Figure 4:
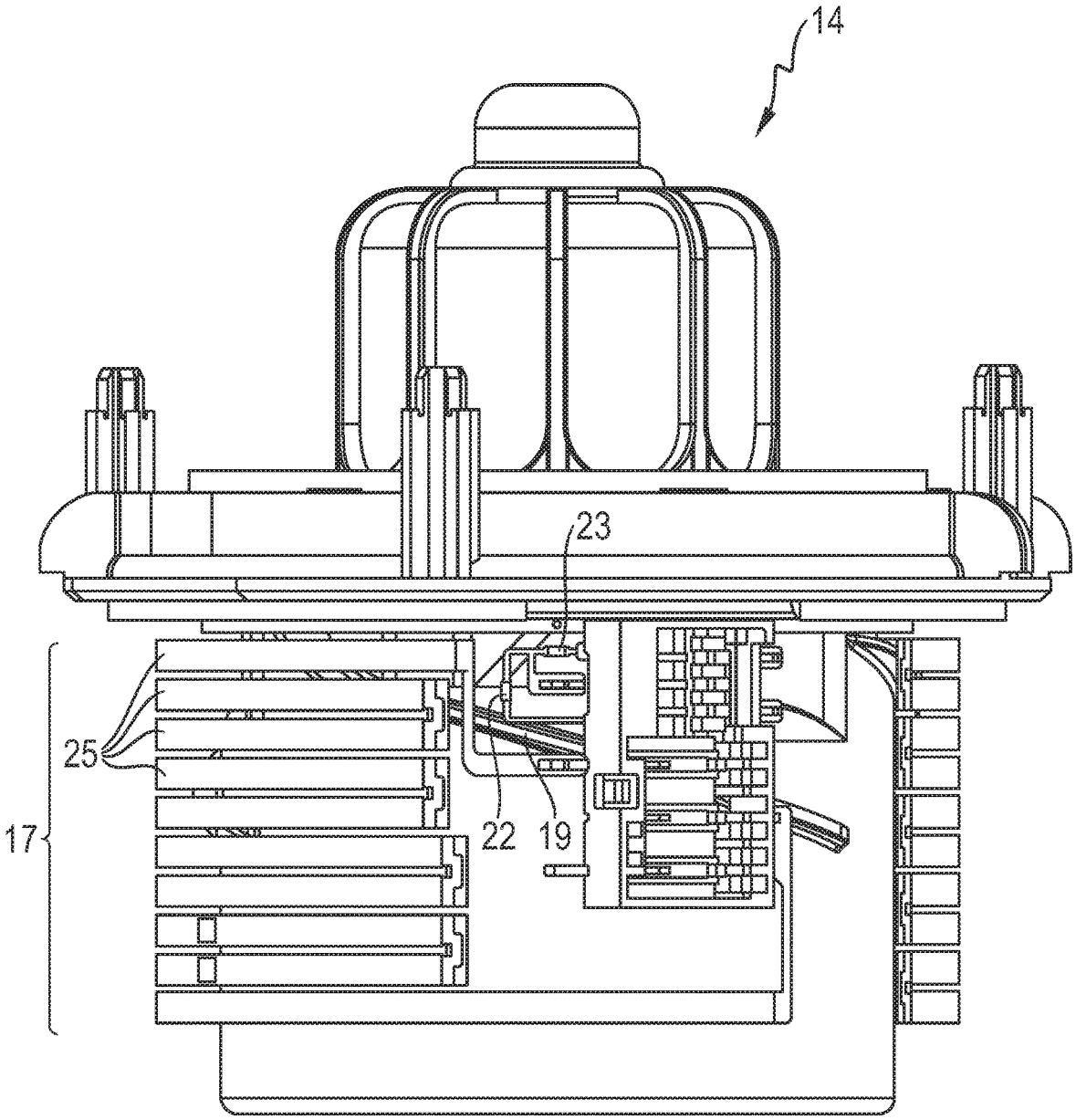
FIG. 4 shows a lateral, partly cut-away and incomplete illustration of a heating pump, having a tube section surrounded by heat conductors.
Figure 5:
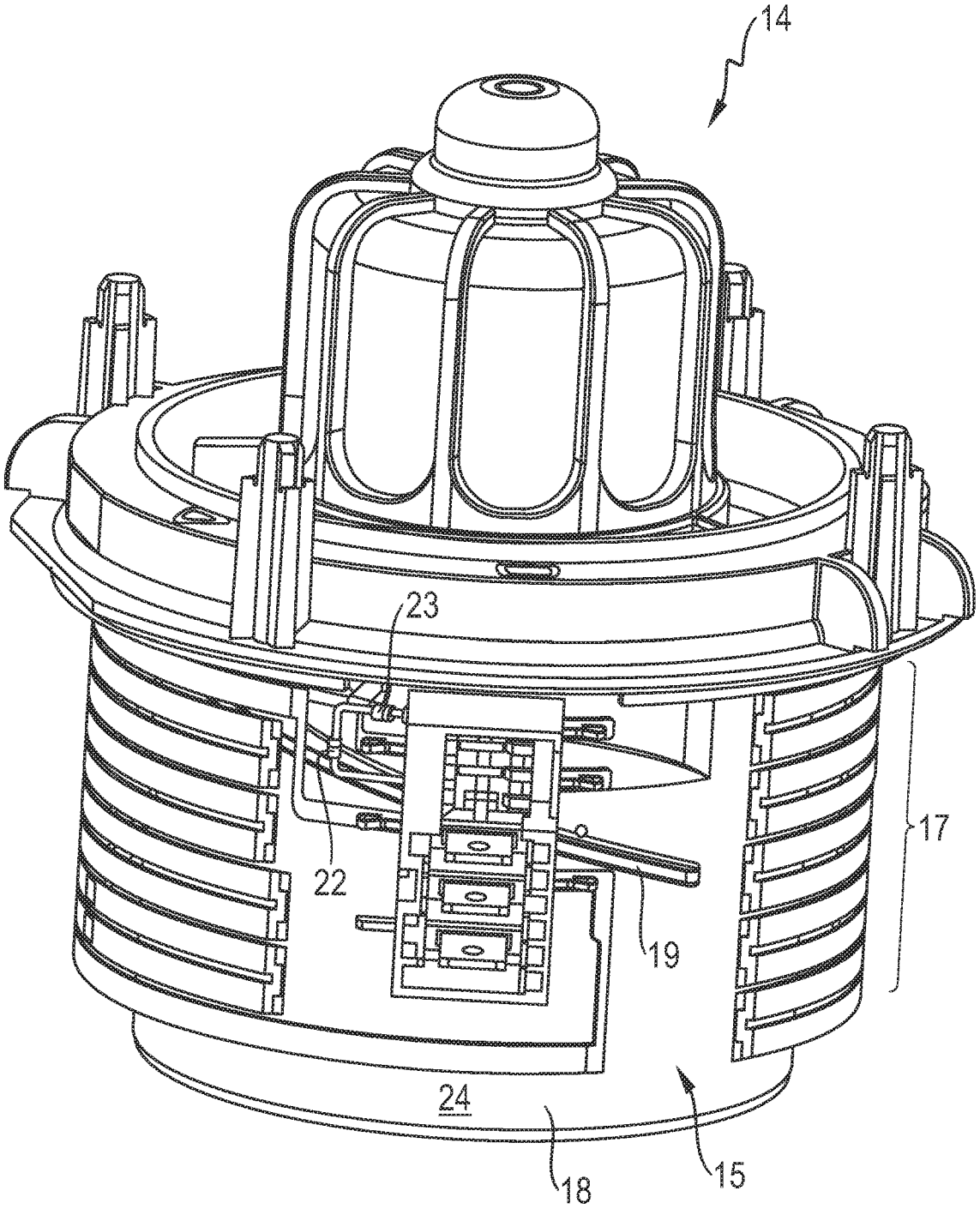
FIG. 5 shows a similar illustration to FIG. 4 but in perspective view.
Figure 6:
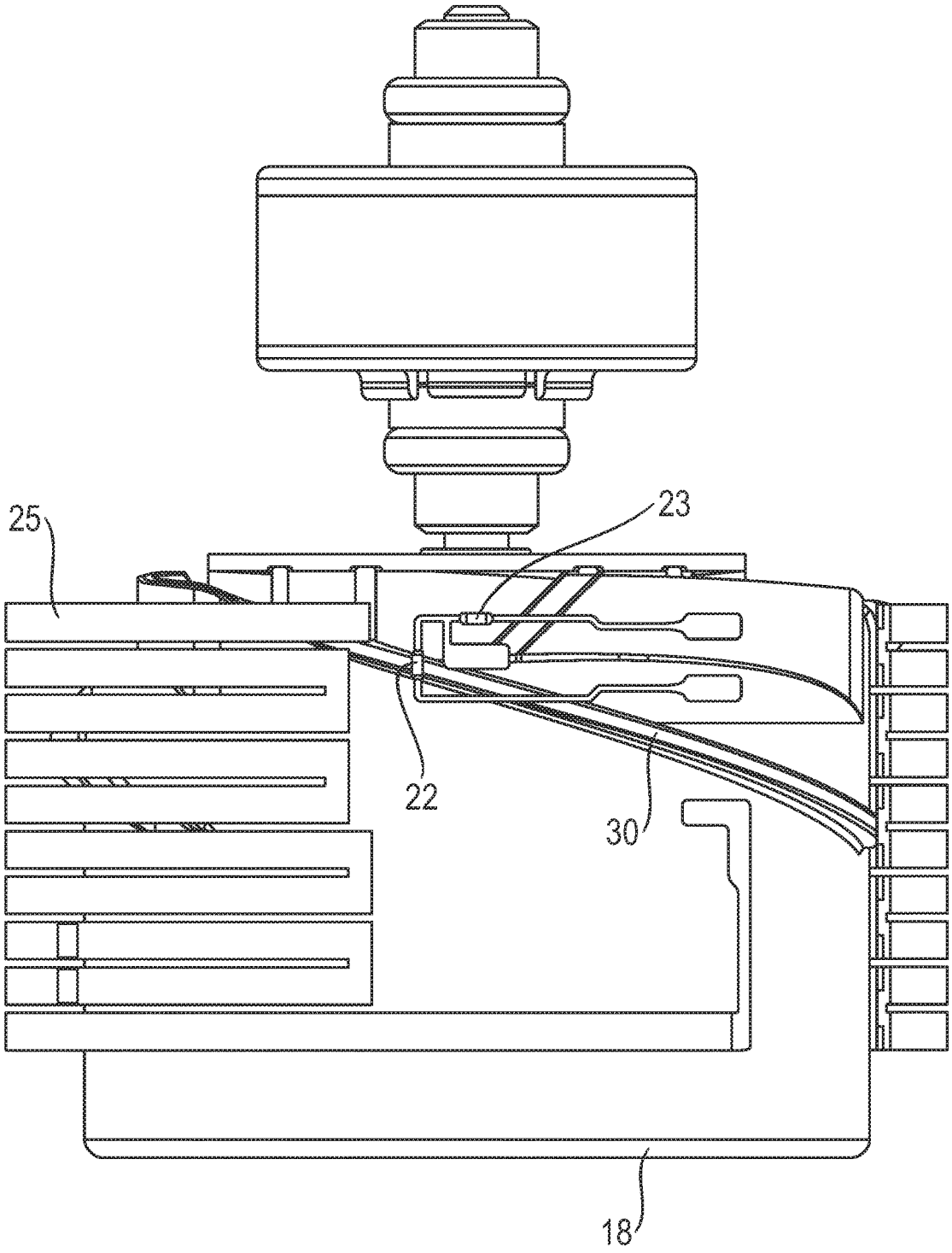
FIG. 6 shows a similar illustration to FIG. 4 but without the surrounding housing parts.
Figure 7:
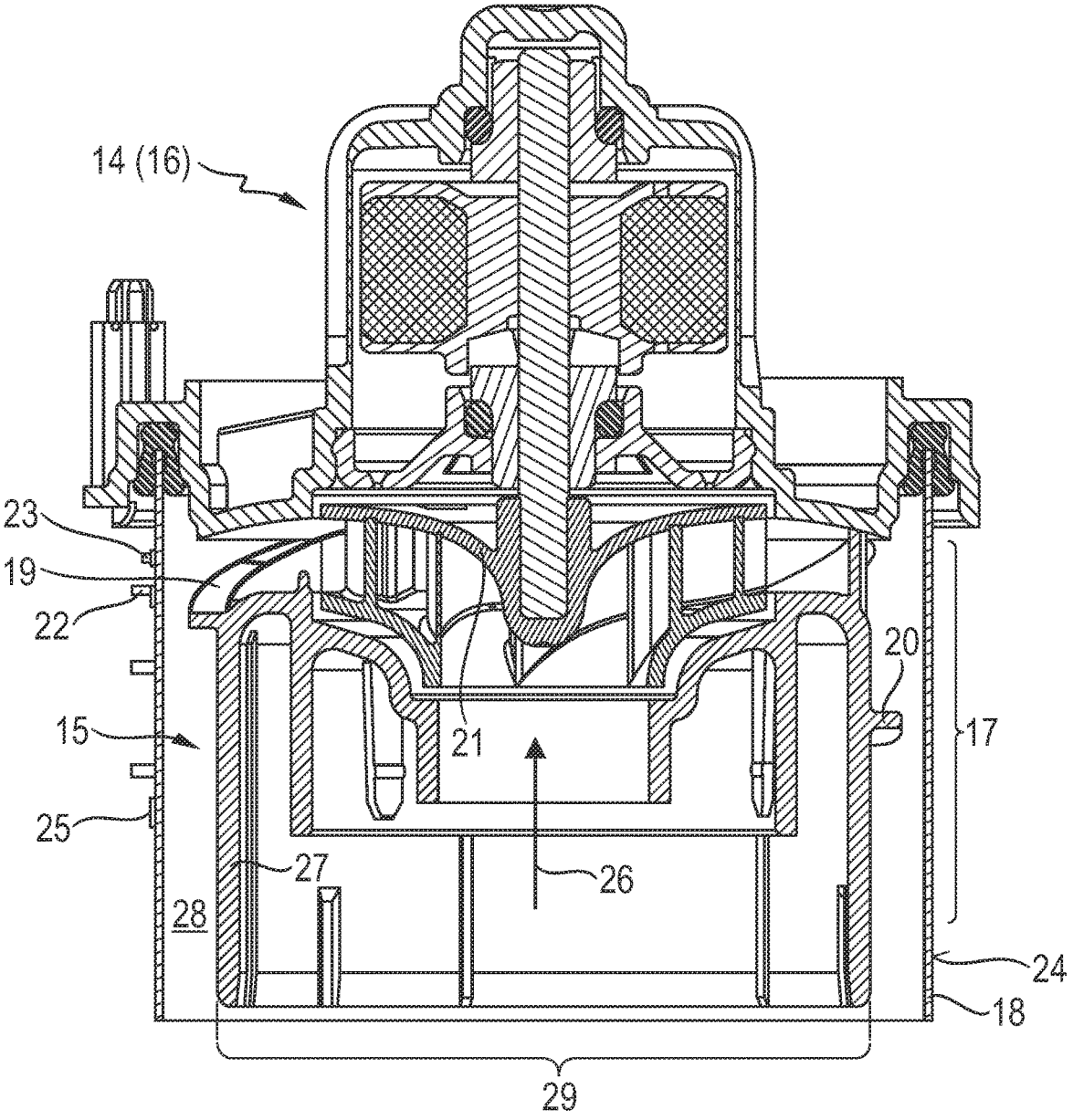
FIG. 7 shows a sectional view of the heating pump according to FIG. 4.
Figure 8:
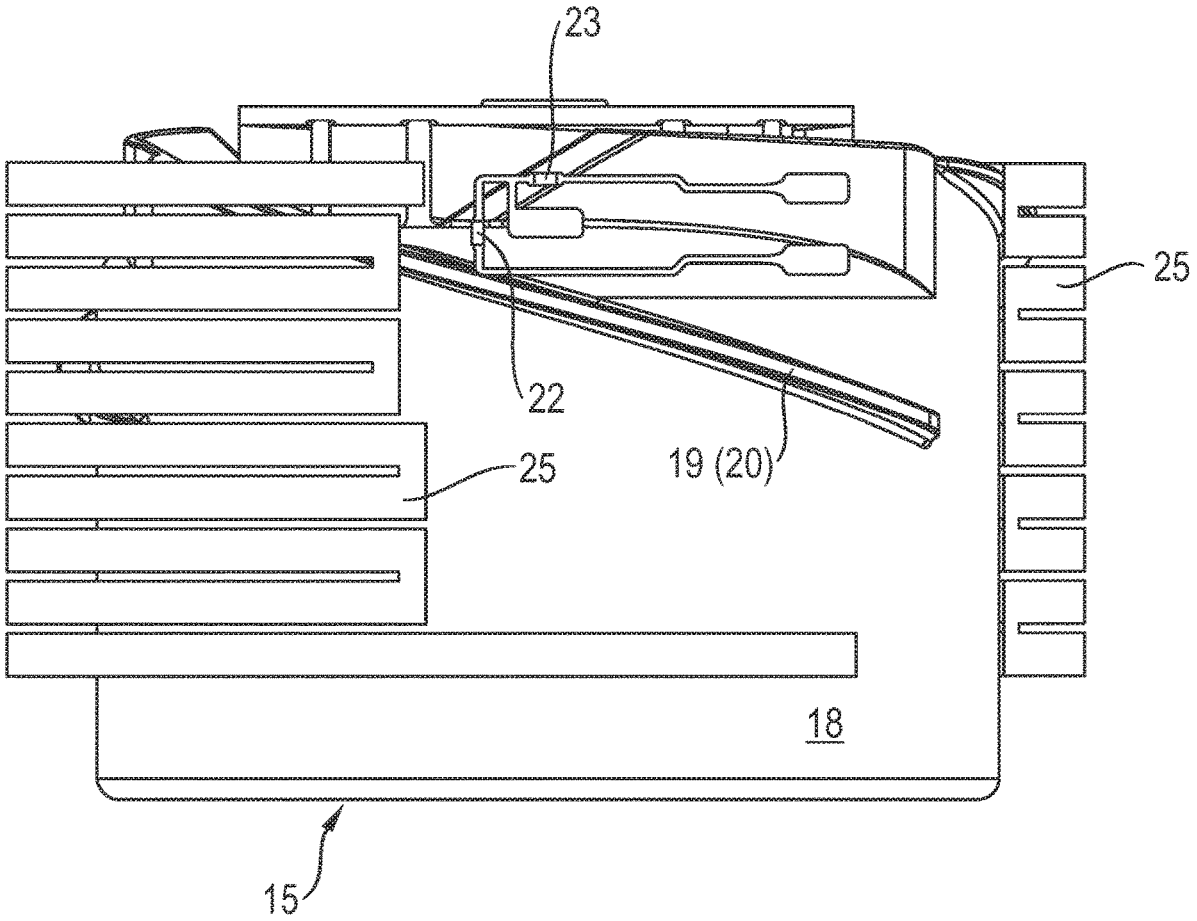
FIG. 8 shows a detail illustration of the inner guide element and the two outside temperature sensors.
Figure 9:
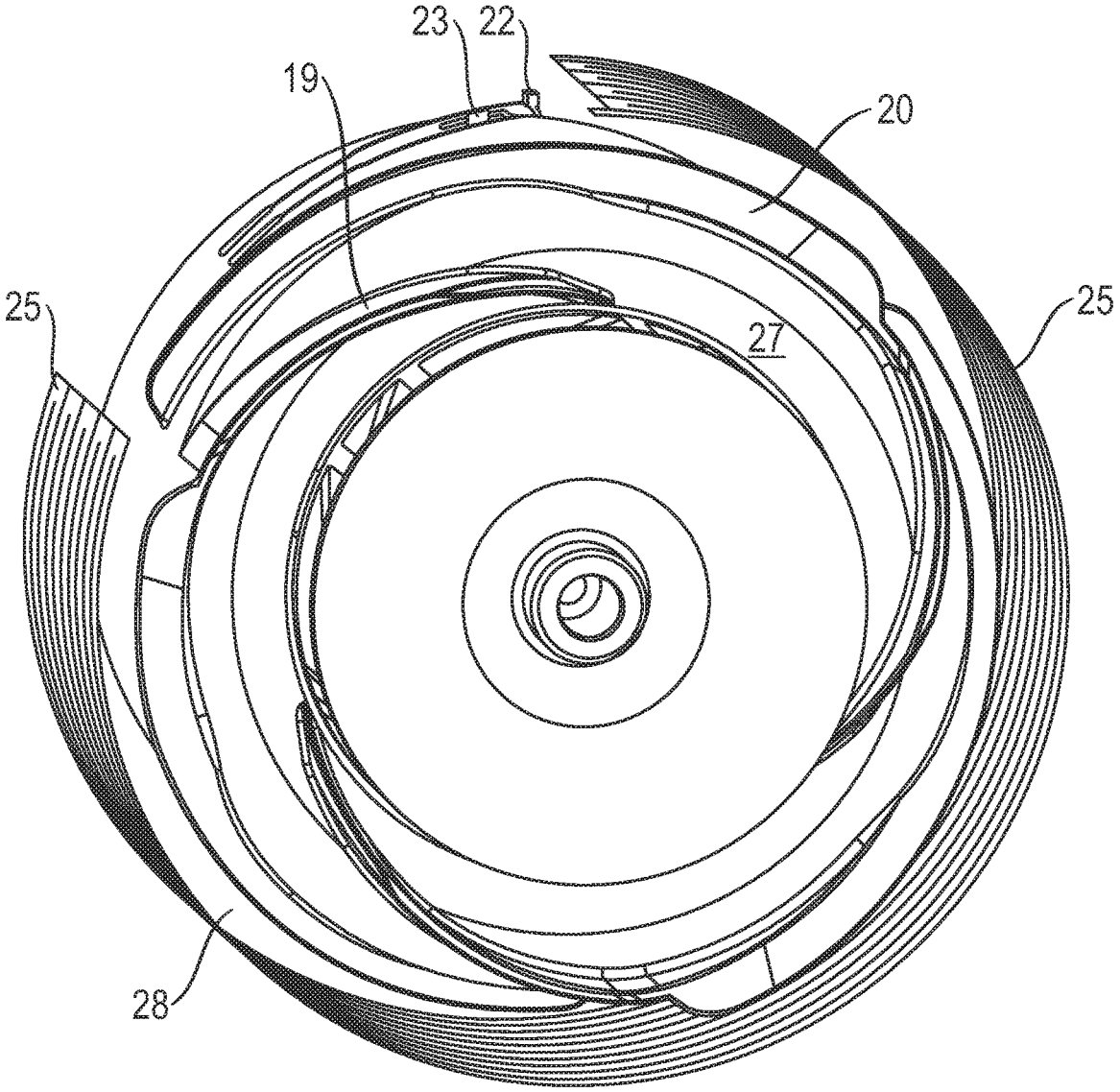
FIG. 9 shows a substantially axial illustration of the guide element, the temperature sensors and the outer heat conductors.
Figure 10:
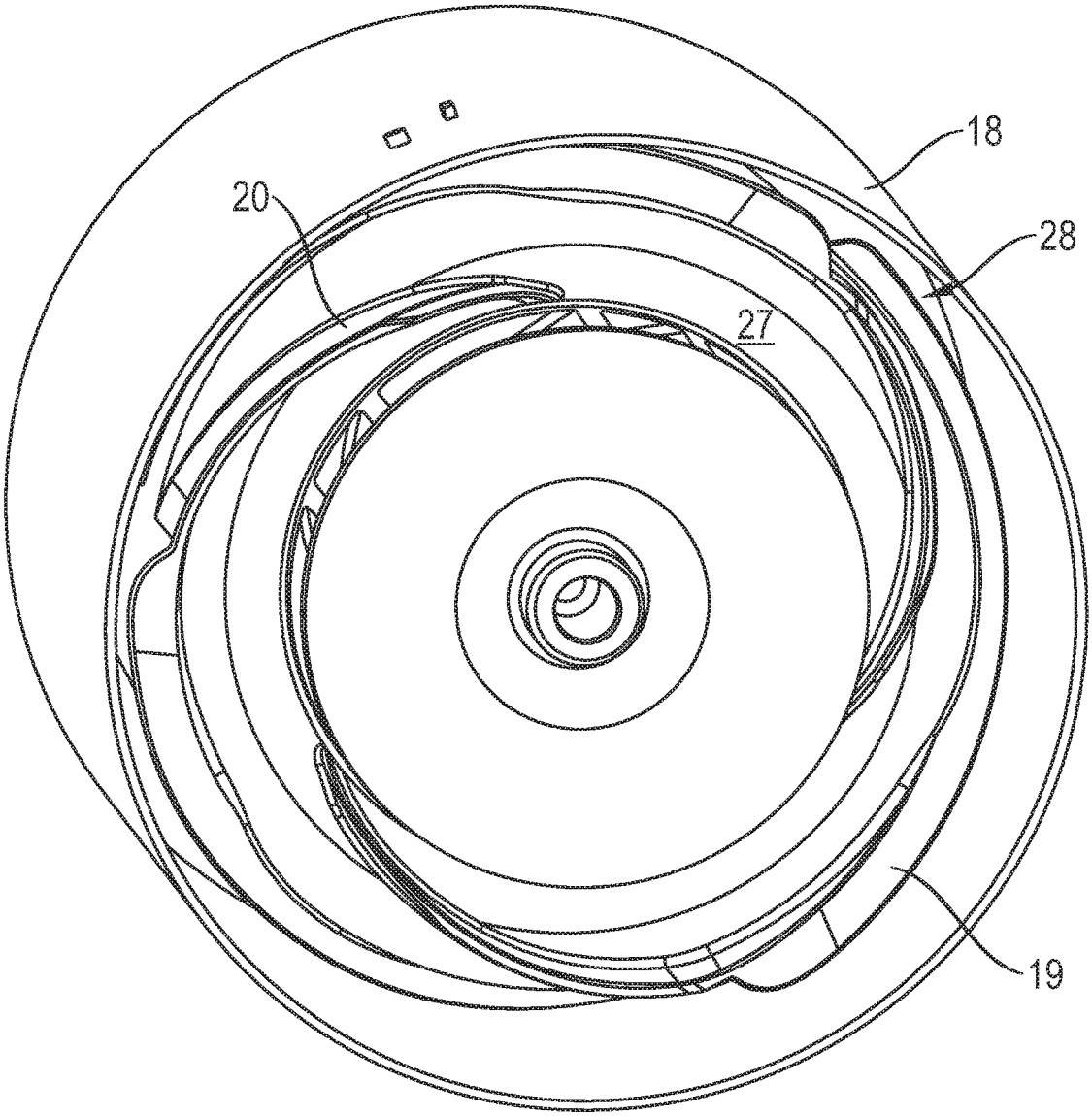
FIG. 10 shows a similar view to FIG. 9 but without the heat conductors and with the wall of the tube section.

Here, by way of example the structural unit 14 forms a heating pump in which the liquid is drawn in axially by suction in the direction 26 and is then deflected by way of the impeller wheel 21 onto a spiral path having one component along the periphery of the wall 18 and one component in opposition to the direction 26. Also contributing to this deflection of the liquid is a central guide element 27 directing the liquid, in the interior of the tube section 15. Radially, this guide element 27 has an approximately cylindrical base element 29 that leaves a sleeve-like spacing gap 28 from the wall 18. Also projecting into this spacing gap 28, which is annular in cross section, are the directing structures 19, 20 that affect the flow rates, which in this case protrude outward of the periphery of the base element 29. These web-like structures 19, 20 thus form guide blades for the incident liquid, and these guide blades extend from the guide element with both an axial and a radially outward component, and hence direct the liquid in a substantially spiral direction of flow. In addition to the deflection, the arrangement of the guide blades 19, 20 may bring about locally varying flow rates of the liquid in the tube section 15. As can be seen for example in FIG. 4, the first temperature sensor 22 is seated radially outward of a structure 19, 20 of this kind in which the flow rate is particularly low, whereas it is significantly higher radially inward of the second temperature sensor 23, with the result that the cooling effect of the liquid taking up heat is greater there, so the temperature measured there is lower.

The guide element 27, with its guide structures 19, 20, is thus arranged in a pump diffusor chamber of the heating pump 14.

In particular, it is favorable if the first temperature measuring device 22 is mounted on the outside of the tube section 15 at a first measuring point below which there extends, in the interior of the tube section, the portion of a guide blade 19, 20 of the guide element that projects radially from the in particular circle-cylindrical base element of the guide element 27, and the second temperature measuring device 23 is mounted on the outside of the tube section 15 at a second measuring point which is different from the first measuring point and closer to the ejection region of the impeller wheel 21, in particular below which the ejection region of the impeller wheel lies. In this case, the flow of liquid flows against the inner wall of the tube section at this first measuring point at a slower flow rate than it does at the second measuring point.

A heating pump 14 for a household appliance of the type described is claimed separately.

With the invention provided here, the flow of liquid through the guiding structures 19, 20 is deliberately made such that incident flow against the second temperature sensor 23, which is connected poorly to the heater 17 in respect of the transverse conduction of heat (being further away from the heat source), is very good or better than against the first temperature sensor 22, which logically must then have a better thermal connection with the heater 17, again in respect of the transverse conduction of heat (see diagram in FIG. 2).

In this way, an evaluable delta value is produced between the two temperature measuring devices 22, 23, which is very small when there is no layer of scale on the heating surface (inner side of the wall 18) but increases as the thickness of the layer of scale grows. Moreover, the different incident flow also affects the production of scale and the build-up of scale such that in the region of the temperature sensor 22, where there is better incident flow, no scale is formed at all, or a thinner layer of scale is formed than in the region of the temperature sensor 23, where there is less incident flow.

These effects make possible a more robust and more reliable evaluation, and by way of an appropriate threshold detection the household appliance 1 can respond to this signal at a preferably defined program point. Possible responses might be displaying a fault or a warning, or indeed making the subsequent washing run longer, with longer re-wash times during washing, a reduced temperature in the rinsing cycle, or similar measures.

Formation of the different flow rates may be achieved in different ways. For this there serves the guide element 27 with its blade-like structures 19, 20, as a result of which different regions with different incident flow against the wall 18 are produced. Further possibilities for implementation might be an appropriate shaping of the pump diffusor chamber, or the positioning of the temperature sensors at different, suitable places.

In all cases, quality-related costs are reduced, and there is a reduction in the TCR (technical call rate) and higher levels of customer satisfaction; preventive measures for any changes in the detergent composition are possible and form an additional feature.

The invention claimed is:

1. A structural unit including a heating pump, said structural unit comprising:

a tube section for a water-conducting household appliance, said tube section being configured such as to enable a liquid to flow through and to be heatable, said tube section including an inner guide wall and an outer wall spaced apart so as to form a spacing gap between the inner guide wall and the outer wall, a mechanical structure arranged in the tube section and configured to effect locally differing flow rates in the liquid, a first temperature measuring device arranged on an outer side of the outer wall of the tube section radially outside a region of lower flow rate, and a second temperature measuring device arranged on the outer side of the outer wall of the tube section radially outside a region of higher flow rate, wherein the mechanical structure is disposed in the spacing gap between the inner guide wall and the outer wall of the tube section and directs the liquid in an interior of the tube section within the spacing gap.

2. The structural unit of claim 1, wherein the tube section is heatable from outside via a heat conductor arranged on an outside of the outer wall.

3. The structural unit of claim 2, wherein the first temperature measuring device has better heat transfer with the heat conductor than the second temperature measuring device.

4. The structural unit of claim 2, wherein the first temperature measuring device is arranged directly on or closely adjacent to the heat conductor, said second temperature measuring device being arranged at a greater spacing from the heat conductor and a further said heat conductor than the first temperature measuring device.

5. The structural unit of claim 2, wherein the heat conductor has a component in a peripheral direction of the tube section, said component being placed upon the tube section or printed directly or indirectly on the outer wall of the tube section.

6. The structural unit of claim 1, wherein each of the first and second temperature measuring devices includes a temperature sensor.

7. The structural unit of claim 1, wherein each of the first and second temperature measuring devices is configured to enable repeated detection of temperatures at regular intervals in time.

8. The structural unit of claim 7, wherein the first and second temperature measuring devices are configured to enable detection of a difference in the temperatures of the first and second temperature measuring devices in an automated manner and generation of an information signal or control signal above a predeterminable limit value by a control unit associated with the structural unit.

9. The structural unit of claim 1, wherein the outer wall of the tube section is made from stainless steel.

10. The structural unit of claim 1, wherein an interior wall surface of the outer wall of the tube section is formed a same throughout in an axial direction.

11. The structural unit of claim 1, wherein the first temperature measuring device is mounted on an outer side of the outer wall of the tube section at a point below which the flow rate of the liquid in the interior of the tube section is at least 10% less than the flow rate of the liquid at a point in the interior of the tube section above which the second temperature measuring device is arranged on the outer side of the outer wall of the tube section.

12. The structural unit of claim 1, wherein the inner guide wall is arranged in a pump diffusor chamber of the heating pump.

13. The structural unit of claim 1, wherein the inner guide wall includes guide blades arranged such as to effect locally varying flow rates of the liquid in the tube section.

14. The structural unit of claim 13, wherein the guide blades extend each from a circle-cylindrical base element of the inner guide wall in a component that extends both axially and radially outward, and further comprising an impeller wheel configured such as to enable flow of the liquid against the inner guide wall, with the guide blades directing the liquid in a substantially spiral direction of flow.

15. The structural unit of claim 14, wherein the first temperature measuring device is mounted on the outer side of the outer wall of the tube section at a first point below which a portion of the guide blades of the inner guide wall extends, which portion projects radially from the base element of the inner guide wall, said second temperature measuring device being mounted on the outer side of the outer wall of the tube section at a second point which is different from the first point and closer to an ejection region of the impeller wheel, and below which the ejection region of the impeller wheel lies.

16. A structural unit including a heating pump, said structural unit comprising:

a tube section for a water-conducting household appliance, said tube section being configured such as to enable a liquid to flow through and to be heatable, a mechanical structure arranged in the tube section and configured to effect locally differing flow rates in the liquid, a first temperature measuring device arranged on an outer side of the tube section radially outside a region of lower flow rate, and a second temperature measuring device arranged on the outer side of the tube section radially outside a region of higher flow rate, wherein the mechanical structure is formed by a guide element that directs the liquid in an interior of the tube section, wherein the guide element includes guide blades arranged such as to effect locally varying flow rates of the liquid in the tube section, and wherein the guide blades extend each from a circle-cylindrical base element of the guide element in a component that extends both axially and radially outward, and further comprising an impeller wheel configured such as to enable flow of the liquid against the guide element, with the guide blades directing the liquid in a substantially spiral direction of flow.

* * * * *